US012703976B2

(12) United States Patent
Thooft et al.

(10) Patent No.: US 12,703,976 B2
(45) Date of Patent: Aug. 11, 2026

(54) POST-TENSIONED CONCRETE WITH FIBERS FOR SLABS ON SUPPORTS

(71) Applicants: NV BEKAERT SA, Zwevegem (BE); CCL STRESSING INTERNATIONAL LTD, Leeds (GB)

(72) Inventors: Hendrik Thooft, Welden (BE); Carol Hayek, Leeds (GB)

(73) Assignees: NV BEKAERT SA, Zwevegem (BE); CCL STRESSING INTERNATIONAL LTD, Leeds (GB)

( * ) Notice: Subject to any disclaimer, the term of this patent is extended or adjusted under 35 U.S.C. 154(b) by 4 days.

(21) Appl. No.: 18/024,842

(22) PCT Filed: Sep. 8, 2021

(86) PCT No.: PCT/EP2021/074703
§ 371 (c)(1),
(2) Date: Mar. 6, 2023

(87) PCT Pub. No.: WO2022/053510
PCT Pub. Date: Mar. 17, 2022

(65) Prior Publication Data

US 2024/0026683 A1 Jan. 25, 2024

(30) Foreign Application Priority Data

Sep. 8, 2020 (EP) ..... 20250002

(51) Int. Cl.
*E04C 5/12* (2006.01)
*E04C 5/07* (2006.01)

(52) U.S. Cl.
CPC ..... *E04C 5/12* (2013.01); *E04C 5/073* (2013.01)

(58) Field of Classification Search
CPC ... E04B 5/04; E04B 5/32; E04C 5/012; E04C 5/073; E04C 5/08; E04C 5/12
See application file for complete search history.

(56) References Cited

U.S. PATENT DOCUMENTS 513,794 A * 1/1894 Lee ..... E04C 5/08 52/223.14
1,633,219 A * 6/1927 Martin ..... B28B 23/02 264/108

(Continued)

FOREIGN PATENT DOCUMENTS

EP 0 851 957 5/2000
EP 1 383 634 10/2006

(Continued)

OTHER PUBLICATIONS

International Search Report and Written Opinion of the International Searching Authority issued Dec. 21, 2021, in International (PCT) Application No. PCT/EP2021/074703.

*Primary Examiner* — James M Ference
(74) *Attorney, Agent, or Firm* — Wenderoth, Lind & Ponack, L.L.P.

(57) ABSTRACT

A concrete slab resting on at least two supports, the concrete slab comprising conventional concrete and a combined reinforcement of both draped post-tension steel strands and fibers, said post-tension steel strands having a diameter ranging from 5 mm to 20 mm, having a tensile strength higher than 1700 MPa, said fibers being either steel fibers and being present in a dosage ranging from 10 kg/m$^3$ to 75 kg/m$^3$ or being macro-synthetic fibers and being present in a dosage ranging from 1.5 kg/m$^3$ to 9.0 kg/m$^3$, whereby the concrete slab and the supports are fully connected, partially connected or fully disconnected.

29 Claims, 2 Drawing Sheets

(56) References Cited

U.S. PATENT DOCUMENTS 3,060,640 A * 10/1962 Harris ..... E04C 5/08 264/261
3,086,273 A * 4/1963 Welborn ..... E04C 5/08 52/223.14
3,184,893 A * 5/1965 Booth ..... E02D 29/055 52/741.15
3,286,421 A * 11/1966 Branstrator ..... E04C 5/201 52/250
3,429,094 A * 2/1969 Romualdi ..... E04C 5/012 106/644
3,500,728 A * 3/1970 Longini ..... E01C 11/18 404/31
3,646,748 A * 3/1972 Lang ..... E04C 5/08 57/7
3,802,492 A * 4/1974 Hilgemann ..... E04B 5/48 165/54
3,808,085 A * 4/1974 Givens, Jr. ..... E01D 19/125 428/401
3,841,597 A * 10/1974 Butts ..... E04G 17/18 249/210
3,845,594 A * 11/1974 Butts ..... E04G 11/42 52/690
3,900,667 A * 8/1975 Moens ..... E04C 5/073 106/644
3,945,168 A * 3/1976 Butts ..... E04G 11/42 52/319
3,979,868 A * 9/1976 Butts ..... E04B 5/32 52/334
4,284,667 A * 8/1981 Moens ..... E04C 5/076 427/435
4,712,344 A * 12/1987 Erdei ..... E04B 5/43 52/80.1
4,776,161 A * 10/1988 Sato ..... D07B 1/162 428/377
5,865,000 A * 2/1999 Nemegeer ..... C04B 14/48 52/309.1
6,256,954 B1 * 7/2001 Thooft ..... E04C 5/20 52/294
6,269,602 B1 * 8/2001 Thooft ..... E04C 5/012 405/231
8,087,204 B1 * 1/2012 Sorkin ..... E04C 5/122 52/223.13
8,919,057 B1 * 12/2014 Dupray ..... E04B 5/36 52/223.6
9,611,645 B1 * 4/2017 Dupray ..... E04C 5/08
2008/0134598 A1 * 6/2008 Rizzuto ..... E04C 5/08 52/223.13
2011/0209345 A1 * 9/2011 Kurosawa ..... D07B 7/185 29/885
2013/0101349 A1 * 4/2013 Wayne ..... E01C 7/185 404/31
2013/0269572 A1 * 10/2013 Lambrechts ..... C04B 14/48 106/638
2014/0034208 A1 * 2/2014 Kurosawa ..... E04C 5/015 156/51
2014/0048975 A1 * 2/2014 Whitmore ..... D07B 7/12 264/259
2015/0176276 A1 * 6/2015 Reigstad ..... E04B 5/32 52/223.6
2015/0176277 A1 * 6/2015 Reigstad ..... E04B 5/32 52/223.6
2015/0176278 A1 * 6/2015 Reigstad ..... E04B 5/32 52/223.6
2016/0032554 A1 * 2/2016 Hicks ..... E04C 3/34 52/223.4
2016/0312464 A1 * 10/2016 Pratt ..... E04B 5/32
2017/0204609 A1 * 7/2017 Reigstad ..... E04C 5/165
2018/0195279 A1 * 7/2018 Pratt ..... E04B 5/32
2018/0195280 A1 * 7/2018 Pratt ..... C04B 16/12
2020/0131770 A1 * 4/2020 Almusallam ..... E04C 5/012
2022/0205240 A1 * 6/2022 Stretch ..... E01C 5/105
2023/0151611 A1 * 5/2023 Thooft ..... E04C 2/044 52/223.6
2024/0026683 A1 * 1/2024 Thooft ..... E04B 5/32
2024/0052634 A1 * 2/2024 Thooft ..... E04B 5/43
2024/0376709 A1 * 11/2024 Thooft ..... E04C 3/26
2024/0376712 A1 * 11/2024 Thooft ..... E04B 5/32

FOREIGN PATENT DOCUMENTS

| | | |
|---|---|---|
| EP | 2 652 222 | 7/2017 |
| EP | 2 652 221 | 8/2017 |
| NZ | 220693 | 11/1990 |
| WO | 2012/080326 | 6/2012 |

* cited by examiner

POST-TENSIONED CONCRETE WITH FIBERS FOR SLABS ON SUPPORTS

TECHNICAL FIELD

The invention relates to a concrete slab comprising conventional concrete and a combined reinforcement of both post-tension steel strands and fibers on at least two supports.

BACKGROUND ART

Post-tensioned concrete is a variant of pre-stressed concrete where the tendons, i.e. the post tension steel strands, are tensioned after the surrounding concrete structure has been cast and hardened. It is a practice known in the field of civil engineering since the middle of the twentieth century.

Steel fiber reinforced concrete is concrete where the reinforcement is provided by short pieces of steel wire that are spread in the concrete. U.S. Pat. No. 1,633,219 disclosed the reinforcement of concrete pipes by means of pieces of steel wire. Other prior art publications U.S. Pat. Nos. 3,429,094, 3,500,728 and 3,808,085 reflect initial work done by the Batelle Development Corporation. The steel fibers were further improved and industrialized by NV Bekaert S A, amongst others by providing anchorage ends at both ends of the pieces of steel wire, see U.S. Pat. No. 3,900,667. Another relevant improvement was disclosed in U.S. Pat. No. 4,284,667 and related to the introduction of glued steel fibers in order to mitigate problems of mixability in concrete. Flattening the bent anchorage ends of steel fibers, as disclosed in EP-B1-0 851 957, increased the anchorage of the steel fibers in concrete. The supply of steel fibers in a chain package was disclosed in EP-B1-1 383 634.

Both reinforcement techniques, post-tensioned concrete and fiber reinforced concrete such as steel fiber reinforced concrete not only exist as such but also in combination. The purpose was to combine the advantages of both reinforcement types to obtain an efficient and reliable reinforced concrete slab.

Prior art concrete slabs with combined reinforcement of both post-tension strands and fibers suffer from an overdesign or from a complex design. In an attempt to stay on the very safe side and to meet the specifications, the dosage of steel fibers is often that high that problems such as ball forming occur during mixing of the steel fibers in the non-cured concrete, despite the existence of prior art solutions. Alternatively, or in addition to this, the distance between two neighbouring post-tension strands or between two neighbouring bundles of post-tension strands cannot exceed certain maximum spacing, causing a lot of labour when installing the post-tension strands, attaching anchors and applying tension. In yet other prior art embodiments the composition of the concrete is such that shrinkage during curing is limited, i.e. for example a low shrinkage concrete or a shrinkage compensating concrete composition may be selected.

An example of a complex design of a concrete slab with reinforcement by both post-tension steel strands and steel fibers is disclosed in NZ-A-220 693. This prior art concrete slab has an under and upper skin layer with steel fibers with a core layer in-between with post-tension tendons.

The present invention may thereby improve the span of the slabs and/or reduce the thickness of the slab and/or the present invention may contribute to reduce the amount of concrete for a given slab thickness or a given span. Furthermore, the present invention may allow for easier and/or faster installation. In addition, the present invention may allow for the slabs to be structural slabs that can for example contribute to structural integrity of a building. The present invention may further contribute to increase the structural capacity for flexure, deflection, shear, punching shear, structural integrity, temperature resistance and/or resistance to shrinkage. The present invention especially allows to combine for example improved shear or punching shear resistance with improved flexural capacity. Furthermore, the present invention advantageously allows for example that post tensioning strands can remain unstressed, even without partial stressing, without the need for shrinkage reinforcement.

DISCLOSURE OF INVENTION

It is a general aspect of the invention to avoid the disadvantages of the prior art.

It is a further general aspect of the invention to avoid overdesign.

It is another aspect of the invention to provide a combination reinforcement of both post-tension strands and fibers to reinforce concrete slabs on supports efficiently and effectively.

It is still another aspect of the invention to provide a combination reinforcement of both post-tension strands and fibers for conventional concrete slabs on supports. The tendons or post-tension steel strands are thereby post-tensioned which means that tension is applied to them only after the concrete has been cast and/or that the tendons or post-tension steel strands may for example remain in place also once the concrete is completely cured/hardened. The tendons or post-tension steel strands may thus be installed on-site and/or may be installed before or after casting. The tendons or post-tension steel strands may comprise anchor systems, that may especially attach the tendons or post-tension steel strands to the cast concrete of the slab according to the invention, and/or ducts or sheathing. This may especially contributes for example to allow to achieve bigger slabs, to help with continuity, to help with safety, to help with camber, to minimize pre-stress losses, especially due to creep, to increase the freedom regarding possible shapes and to facilitate a draped configuration of the tendons or post-tension steel strands. In contrast, pre-tensioning is used mostly for pre-cast elements casted off-site with tendons fixed to a form and being tensioned before any concrete is cast. The resulting pre-cast elements obtained by pre-tensioning are thus consequently of quite limited size due to the very need to use forms or moulds, so that flooring may usually require multiple pre-cast elements.

According to the invention, there is provided a concrete slab resting on at least two supports, the slab comprising conventional concrete and a combined reinforcement of both draped post-tension steel strands and fibers, said post-tension steel strands
- having a diameter ranging from 5 mm to 20 mm,
- having a tensile strength higher than 1700 MPa, said fibers being either steel fibers and being present in a dosage ranging from 10 kg/m$^3$ to 60 kg/m$^3$ or being macro-synthetic fibers and being present in a dosage ranging from 1.5 kg/m$^3$ to 9.0 kg/m$^3$, whereby the slab and the supports are fully connected, partially connected or fully disconnected.

The tendons or post-tension steel strands having a diameter ranging from 5 mm to 20 mm, e.g. from 6 mm to 20 mm, e.g. from 6.5 mm to 18.0 mm, e.g. from 13 mm to <18.0 mm. The post-tension steel strands have a tensile strength higher than 1700 MPa, e.g. higher than 1800 MPa, e.g. higher than 1900 MPa, e.g. higher than 2000 MPa, preferably between 1800 MPa and 4000 MPa. The post-tension steel strands may also for example have a maximum breaking load of higher than 190 kN, e.g. higher than 195 kN, e.g. higher than 200 kN, e.g. higher than 220 kN, preferably between 195 kN and 350 kN.

The tendons or post-tension steel strands may be bonded or unbonded. In addition, the steel strands may preferably for example be present in bundles.

Particularly with a view to be used as post-tension steel strand, the steel strand preferably has a low relaxation behaviour, i.e. a high yield point at 0.1% elongation. The yield point at 0.1% can be considered as the maximum elastic limit. Below the yield point, the post-tension strand will remain in elastic mode. Above the yield point, the post-tension strand may start to elongate in plastic mode, i.e. an elongation that is not reversible. Preferably, the ratio of the yield strength $R_{p0,1}$ to the tensile strength $R_m$ is higher than 0.75.

Low relation post-tension steel strands may have relaxation losses of not more than 2.5% when initially loaded to 70% of specified minimum breaking strength or not more than 3.5% when loaded to 80% of specified minimum breaking strength of the post-tension steel strand after 1000 hours.

The fibers can be steel fibers and may be present in a dosage ranging for example from 10 kg/m$^3$ to 45 kg/m$^3$, preferably from 10 kg/m$^3$ to 40 kg/m$^3$, alternatively from ≥25 kg/m$^3$ to 75 kg/m$^3$, preferably from >40 kg/m$^3$ to 60 or 65 kg/m$^3$, further preferred from 15 kg/m$^3$ to 40 kg/m$^3$, further preferred from >20 kg/m$^3$ to <40 kg/m$^3$, preferably from 15 kg/m$^3$ to 35 kg/m$^3$, preferably from 20 kg/m$^3$ to 30 kg/m$^3$ or from 10 kg/m$^3$ to <30 kg/m$^3$ or further preferred from 10 kg/m$^3$ to 27 kg/m$^3$. In an embodiment, the amount of steel fibers used according to the present invention may be for example preferably below or equal to 1.2 times, preferably 1.0 time, further preferred between >0 and 1.1 times, the amount or level of steel recommended and used for the steel bars or rebars to be replaced and/or the amount or level of steel fibers may be below or equal 1.2 times, preferably 1 time, further preferred between >0 and 1.1 times, the amount or level recommend as rebar or steel bar replacement. The fibers can also be macro-synthetic fibers and may, in such case, be present in a dosage ranging from 1.5 kg/m$^3$ to 9 kg/m$^3$, e.g. from 2.5 kg/m$^3$ to 7 kg/m$^3$, e.g. from 3.5 kg/m$^3$ to 5.0 kg/m$^3$.

The fibers can be macro-synthetic fibers and are present in a dosage ranging from 1.5 kg/m$^3$ to 9 kg/m$^3$, e.g. from 2.5 kg/m$^3$ to 7 kg/m$^3$, e.g. from 3.5 kg/m$^3$ to 5.0 kg/m$^3$.

The fibers are present in all parts of the concrete slab, i.e. the concrete slab is preferably a monolithic slab and the fibers are substantially homogeneously or homogeneously distributed in the concrete slab. Substantially homogeneously may thereby mean for example except for a very thin (preferably below 10 mm, further preferred below 6 mm) upper skin layer that is applied to provide a flat and wear resistant surface to the slab and to avoid fibers from protruding. This may especially allow to contribute for example to improving punching shear. This may mean that a slab according to the invention does therefore especially not comprise regions or parts of lower density, especially no aggregated and/or aerated parts and/or no polymer based insulating material, further more preferred no aggregated and/or aerated blocks and/or no polymer based insulating material, which has/have a lower density, especially compared to cast concrete. In an embodiment, the slab may preferably be cast in one or multiple steps, preferably in one step. A concrete slab in the sense of the present invention may thereby further for example also preferably be cast in one day and/or in one go and/or be fully casted, whereby especially for example no use of or assembly of blocks or other concrete parts is involved. A concrete slab in the sense of the present invention may further for example contain only the fibers and the post-tension steel strands as reinforcement elements, which especially for example may mean that the slab may be free of any other reinforcement elements, especially other metal or steel reinforcement elements besides the fibers and the post-tension steel strands, especially free of rebars or steel bars, steel mesh, steel rods or the like. A concrete slab in the sense of the present invention there comprises both fibers and post-tension steel strands. A concrete slab in the sense of the present invention may comprise a slip-sheet, especially for example a perforated slip-sheet. On the other hand, a concrete slab in the sense of the present invention may thereby further for example be free of a vapor barrier, especially at the basis of the concrete slab, so that said slab does preferably not comprise a vapor barrier.

Dosages of fibers of 10 kg/m$^3$ to 40 kg/m$^3$ in case of steel fibers and 1.5 kg/m$^3$ to 9 kg/m$^3$ in case of macro-synthetic fibers are low to moderate in comparison with prior art dosages of more than 40 kg/m$^3$ or more than 9 kg/m$^3$. Such low to moderate dosages may for example further allow integrating the fibers in a more homogeneous way in the concrete and facilitate the mixing of the fibers in the concrete. In an embodiment of the present invention, the fibers may for example have a length of 10 mm to 100 mm, further preferred between >10 mm and 70 mm, further preferred >11 mm and <65 mm. This may contribute for example also to a good anchorage of the fibers in concrete and/or to limit crack sizes and/or to allow for self-healing. This may further help to the fibers to be particularly useful for example in structural applications, where they can contribute to the slab strength, especially for example to resist flexural stresses and/or shear forces.

The conventional concrete preferably has a characteristic compressive cube strength or comparable cylinder strength 25 N/mm$^2$ or higher, preferably 28 N/mm$^2$ or higher, further preferred 30 N/mm$^2$ or higher. More preferably, the conventional concrete has a strength equal to or higher than the strength of concrete of the C20/25 strength classes as defined in EN206 or equivalent national code requirements and smaller than or equal to the strength of concrete of the C50/60 strength classes as defined in EN206. These types of concrete are widely available and avoid adding ingredients that reduce the shrinkage during hardening. For the avoidance of doubt, self-compacting concrete is considered as conventional concrete. Conventional concrete in the sense of the present invention may thereby especially also for example have normal shrinkage and/or may not encompass low shrinkage concrete. In a preferred embodiment, the slab does not contain any further reinforcement elements, such as rebars or steel nets or steel mesh beside steel fibers and post-tensioning steel strands, especially there may no rebars neither at the top nor at the bottom, further preferred there may also be for example even no rebars at the supports. It is thereby especially advantageous that the slabs according the present invention can act as structural slabs, especially for example to contribute to the structural integrity of a building. A concrete slab according to the invention may thereby especially have a thickness for example between 4 cm and 75 cm, preferably between 5 cm and 65 cm, further preferred between 10 cm and 55 cm, further preferred between >10 cm and <40 cm and/or have a width higher than the thickness and/or have a width higher than the thickness and a length higher than the thickness. In an embodiment, a concrete slab according to the invention may especially for example have the outline of a rectangular cuboid. In an embodiment, a concrete slab according to the invention may especially for example have the outline of a cuboid or of a rectangular cuboid, whereby preferably the gross sectional modulus of inertia may be according to the formula $b \cdot h^3/12$ with 'b' being the width of the slab and 'h' being the thickness of the slab.

In a preferable embodiment of the invention, the fibers are steel fibers and have a straight middle portion and anchorage ends at both ends. Steel fibers may thereby especially contribute to allow for example for good dispersion in concrete and/or good compatibility with concrete. The use of steel fibers, alone or especially also in combination with post-tensioning that may exert compression, may for example also help to limit crack sizes and/or allow for self-healing. Furthermore, the use of steel fibers may also for example contribute to the formation of irregular cracks that, delay moisture propagation and thus help to improve the durability of the slab. Steel fibers may further have a high tensile strength and/or a high E-modulus and/or a high shear resistance, which may make them particularly useful for example in structural applications, where they can contribute to the slab strength, especially for example to resist flexural stresses and/or shear forces.

Most preferably the tensile strength of the middle portion is above 1400 MPa, preferably above 1500 MPa, preferably above 1600 MPa, preferably above 1700 MPa, further preferred above 1900 MPa, even further preferred above 2000 MPa, even further preferred higher than 2200 MPa, preferably between 1400 MPa and 3500 MPa.

The anchorage ends preferably each comprise three or four bent sections. Examples of such steel fibers are disclosed in EP-B1-2 652 221 and in EP-B1-2 652 222. These may be particularly useful in view of their good dosage/performance ratio, especially in combination with post tensioning as in the present invention, so that they may contribute to achieve good performance, especially regarding for example crack control, at relatively moderate dosages.

In an embodiment of the invention, the supports may be concrete supports, masonry supports, steel supports or supports combining concrete, masonry and/or steel.

In an embodiment of the invention, the supports may be part of a foundation, preferably located underneath the slab and/or away from the foundation, or preferably, the supports may not be part of a foundation. In case the supports are part of a foundation of a building, they may be preferably in contact with the soil or ground. On the other hand, in the case the supports are not part of a foundation of a building, the slab may preferably be a so-called elevated slab, they may especially be part of a multi-story building above or below the ground level. Elevated slabs and/or their supports may thereby preferably not be contact with the soil or ground, preferably elevated slabs (in contrast to slabs laid on the ground) may thereby also not be uniformly supported along the slab but rather punctually supported at the supports. It is thereby especially advantageous that the slabs according the present invention can act as or be structural slabs, especially for example to contribute to the structural integrity and structural resistance of a building. In contrast, slabs laid on the ground do for example not act as structural slabs. Slabs according to the present invention can thereby preferably be for example elevated slabs that are structural slabs.

In an embodiment of the invention, the supports may comprise columns, walls, piles or beams or any combination thereof or any other elements acting as vertical support, whereby further such supports can especially be point supports, linear supports or area supports.

In the present invention, the post-tension steel strands may be draped i.e. they are positioned for example to take away as much as possible the tensile stresses in the concrete, so that above the supports they are positioned in the upper half of the concrete slab and in-between the supports they are positioned in the lower half of the concrete slab.

In an embodiment of the invention, the post-tension steel strands may be in a banded-banded steel strands configuration or in a banded-distributed steel strands configuration or in a configuration resulting from any combination thereof, and/or the post tension steel strands can be arranged in any configuration, preferably without any maximum and/or minimum spacing requirements and/or the post-tension steel strand may be used for bonded or unbonded post-tensioning and/or the anchors for the post-tension steel strands may be designed as described for example in patent application U.S. 63/052,283 so as to reduce bursting behind the post-tensioning anchors during or after post-tensioning and/or wherein the fibers are substantially homogenously or homogeneously distributed in the slab. A banded or banded-banded configuration of steel strands may thereby allow to keep the slab freer from steel strands, so as to allow for example for more design freedom or safe drilling through the slabs. Bonded post-tensioning may thereby use bonded strands that may be bonded to the concrete of the slabs for example using grout, so that even in case of a problem an anchor structural integrity is preserved through the bonding. On the other hand, unbonded post-tensioning strand may be provided with a plastic sheeting and may not be connected to the concrete of the slabs.

The supports may be arranged in a regular rectangular pattern or quadrilateral shape where a set of four supports or a set of four groups of supports forms a quadrilateral shape. The concrete slab comprises straight zones at the supports that connect the supports in the two directions, i.e. in length direction and in width direction, the shortest distance between those areas of the concrete slab above the supports. The straight zones have a width that may vary between 0% and 80%, e.g. between 5% and 50% of the greatest cross-sectional dimension of the slab width direction between two supports. Post-tension steel strands are present in bundles in those straight zones. The presence of bundles of post-tension steel strands in the straight zones is often referred to as banded pattern. Post-tension steel strands may or may not be present outside the straight zones.

In an embodiment, the supports may be arranged to form a regular rectangular pattern or quadrilateral shape, the concrete slab comprising straight zones connecting the supports via the shortest distance in two directions, i.e. lengthwise and width-wise, post-tension steel strand bundles being present only in said straight zones in closely-spaced arrangement, where for example the maximum distance between bundles may not exceed 0.8 m, in a so-called banded-banded configuration, and/or the supports may be arranged to form a regular rectangular pattern or quadrilateral shape, the concrete slab comprising straight zones connecting the supports via the shortest distance in two directions, i.e. lengthwise and width-wise, post-tension steel strand bundles in any or both directions being present inside and/or outside said straight zones in a largely-spaced arrangement, where for example the maximum distance between bundles may exceed 1.5 m, in a so called distributed or banded-distributed configuration. A bundle may thereby be a closely spaced arrangement, where two or more individual strands that may be arranged in close proximity to each other to form a bundle, whereby preferably the maximum distance between individual strands of a bundle may be <0.8 m, further preferred <0.25 m. As individual strands may be rarely used, as such, but may be more frequently used as part of a bundle, strands and bundles can be used interchangeably (or as synonyms) herein. A banded-distributed configuration is thereby achieved by having steel strand bundles arranged in a closely spaced arrangement one way i.e. in one direction (for example widthwise) and arranged in a largely spaced arrangement the other way i.e. in the other direction (for example lengthwise). Strands or bundles of strands can thereby be arranged especially for example in an arrangement selected from the group of: a two way distributed arrangement, a one way banded and one way distributed arrangement, a one way banded and one way mixed arrangement, whereby a mixed arrangement comprises both strands or bundles both in banded and distributed arrangements, a two way banded arrangement, a one way banded and one way mixed arrangement, whereby a mixed arrangement comprises both strands or bundles both in banded and distributed arrangements, a two way mixed arrangement, whereby a mixed arrangement comprises both strands or bundles both in banded and distributed arrangements.

In an embodiment, the slab and the supports may be either permanently fully connected, so that the slab is not free to move from its supports, permanently fully disconnected, so that the slab is free to move, partially connected, so that the slab is partially free to move in certain directions or temporarily disconnected, so that the slab is free to move at least temporarily until a connection is put in place. A disconnection or partial connection may thereby allow for example to reduce shortening restraint forces that may appear upon shrinkage and may lead to large cracks. This may be particularly useful for example for very stiff or very long slabs that may be particularly susceptible to shortening restraint forces for example due to the shrinkage of concrete, due to elastic shortening related to post-tensioning, due to creep of concrete or due to temperature changes. On the other hand, a connection may help to support higher loads, especially for example seismic loads.

In an embodiment, the span of the slabs between two supports for a given thickness is increased by between 5 and 50%, preferably between 10 or 40% or between 15 and 35%, further preferred at least 5%, 15%, 20%, 25% or 30% over a slab with the same slab thickness but without fibers and post-tension steel strands and/or wherein the thickness of the slab for a given span between two supports is reduced by between 5 and 50%, preferably between 10 or 40% or between 15 and 35%, further preferred at least 5%, 15%, 20%, 25% or 30% over a slab with the same span but without fibers and post-tension steel strands.

In an embodiment, the amount concrete can be reduced for a given thickness or a given span over a slab but without fibers and post-tension steel strands by between 5 and 50%, preferably between 10 or 40% or between 15 and 35%, further preferred at least 5%, 15%, 20%, 25% or 30%.

In an embodiment, the combination of post-tensioned steel strands and fibers may contribute to increases in the structural capacity for flexure, deflection, shear, punching shear, temperature resistance and/or resistance to shrinkage over a slab without steel fibers and/or steel strands. The present invention can thereby especially contribute to increase punching shear by for example 10% to 100%, preferably 20% to 60% compared to embodiments not according to the invention. Said combination can replace partially or totally any other form of steel reinforcement, and/or replace partially or totally over-thickening measures at supports such as for example drop cap or drop panel.

MODE(S) FOR CARRYING OUT THE INVENTION

Explanation of the Principle Behind the Invention

Concrete is a very brittle material that is hardly resistant to tensile tensions, the purpose is to avoid or at least to reduce the presence of tensile stresses.

Figure 1:
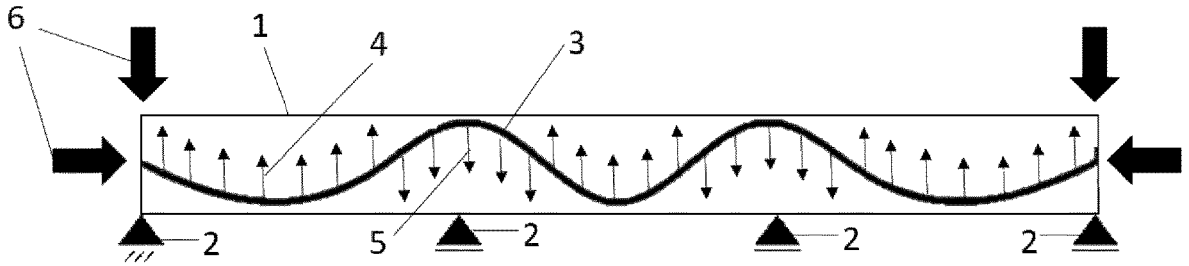
FIG. 1 shows a schematic representation of a slab on supports.

FIG. 1 shows a schematic representation of a slab (1) on supports (2) with a draped post-tensioning steel strand (3) creating uplift forces (4) in-span and downward forces (5) at the supports (2), and concentrated loads (6) at the anchors.

Figure 2A:
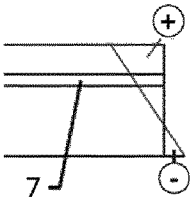
FIG. 2*a* shows a concrete slab reinforced by a post-tension steel strand located in the upper part of the slab.

FIG. 2*a* shows a concrete slab reinforced by means of a post-tension steel strand (7) that is located in the upper part of the slab. No external loads are present here. The post-tension steel strand (7) creates compressive stresses in the upper part of slab and tensile stresses in the lower part of slab. The e symbol, a plus sign in a circle, points to compressive stresses, while the e symbol, a minus sign in a circle, points to tensile stresses in FIG. 2 and FIG. 3.

Figure 2B:
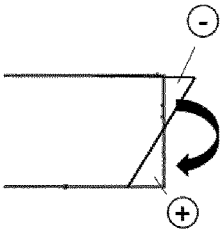
FIG. 2*b* shows a schematic representation of a concrete slab with a negative applied moment.

FIG. 2*b* shows a schematic representation of a concrete slab with a negative applied moment represented by an arrow, which may represent the situation occurring for example at the supports. Compressive and tensile stresses resulting from the applied moment are show too.

Figure 2C:
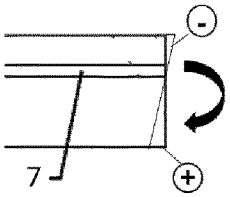
FIG. 2*c* shows a schematic representation corresponding to FIG. 2*b* where tensile stresses have been reduced by the addition of a post-tensioning strand.

FIG. 2*c* shows a schematic representation corresponding to FIG. 2*b* but where tensile stresses have now been reduced by the addition of the post-tensioning strand (7). This may especially allow to contribute to reduce or prevent the formation of cracks.

Figure 3A:
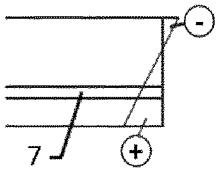
FIG. 3*a* shows a concrete slab reinforced by a post-tension steel strand located in the lower part of the slab.

FIG. 3*a* shows a concrete slab reinforced by means of a post-tension steel strand (7) that is located in the lower part of the slab. No external loads are present here. The post-tension steel strand (7) creates compressive stresses in the lower part of slab and tensile stresses in the upper part of slab.

Figure 3B:
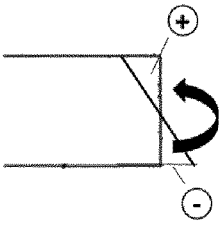
FIG. 3*b* shows a schematic representation of a concrete slab with a positive applied moment.

FIG. 3*b* shows a schematic representation of a concrete slab with a positive applied moment represented by an arrow, which may represent the situation occurring for example at in-span.

Figure 3C:
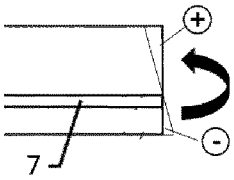
FIG. 3*c* shows a schematic representation corresponding to FIG. 3*b* where tensile stresses have been reduced by the addition of a post-tensioning strand.

FIG. 3*c* shows a schematic representation corresponding to FIG. 3*b* but where tensile stresses have now been reduced by the addition of the post-tensioning strand (7). This may especially allow to contribute to reduce or prevent the formation of cracks.

In some embodiments, a post-tension steel strand may also be arranged in the middle of the slab.

However, no position can guarantee the total absence of tensile stresses. Within the context of the present invention, post-tension steel strands may therefore be designed especially for example to take up and compensate the tensile stresses that may originate during hardening and shrinkage of a concrete in addition to applied loads. The post-tension steel strands are of a sufficiently high tensile strength, i.e. above 1700 MPa or even above 1800 MPa, so that conventional concrete can be used and ingredients to compensate shrinkage can be avoided.

The fibers are mixed in the concrete as homogeneously as possible so that may preferably be present over the whole volume of the slab and able to take tensile stresses caused by various loads.

In a second embodiment of the invention, a concrete slab is formed on supports. A slip-sheet may be or may not be present between the supports and the slab.

Post-Tension Steel Strand

A typical post-tension steel strand may have for example a 1+6 construction with a core steel wire and six layer steel wires twisted around the core steel wire. In an embodiment, the post-tension steel strand may be in a non-compacted form.

In an alternative preferable embodiment, the post-tension steel strand may be in a compacted form. In this compacted form, the six layer steel wires no longer have a circular cross-section but a cross-section in the form of a trapezium with rounded edges. A compacted post-tension steel strand has less voids and more steel per cross-sectional area.

As mentioned, the post-tension steel strand may have a high yield point, i.e. the yield force at 0.1% elongation is high. The ratio yield force $F_{p0,1}$ to breaking force $F_m$ is higher than 75%, preferably higher than 80%, e.g. higher than 85%.

A typical steel composition of a post-tension steel strand is a minimum carbon content of 0.65%, a manganese content ranging from 0.20% to 0.80%, a silicon content ranging from 0.10% to 0.40%, a maximum sulfur content of 0.03%, a maximum phosphorus content of 0.30%, the remainder being iron, all percentages being percentages by weight. Most preferably, the carbon content is higher than 0.75%, e.g. higher than 0.80%. Other elements as copper or chromium may be present in amounts not greater than 0.40%.

All steel wires may be provided with a metallic coating, such as zinc or a zinc aluminium alloy. A zinc aluminium coating has a better overall corrosion resistance than zinc. In contrast with zinc, the zinc aluminium coating is temperature resistant. Still in contrast with zinc, there is no flaking with the zinc aluminium alloy when exposed to high temperatures.

A zinc aluminium coating may have an aluminium content ranging from 2 percent by weight to 12 percent by weight, e.g. ranging from 3% to 11%.

A preferable composition lies around the eutectoid position: Al about 5 percent. The zinc alloy coating may further have a wetting agent such as lanthanum or cerium in an amount less than 0.1 percent of the zinc alloy. The remainder of the coating is zinc and unavoidable impurities.

Another preferable composition contains about 10% aluminium. This increased amount of aluminium provides a better corrosion protection then the eutectoid composition with about 5% of aluminium.

Other elements such as silicon (Si) and magnesium (Mg) may be added to the zinc aluminium coating. With a view to optimizing the corrosion resistance, a particular good alloy comprises 2% to 10% aluminium and 0.2% to 3.0% magnesium, the remainder being zinc. An example is 5% Al, 0.5% Mg and the rest being Zn.

An example of a post-tension steel strand is as follows:

diameter 15.2 mm;
steel section 166 $mm^2$;
E-modulus: 196000 MPa;
breaking load $F_m$: 338000 N;
yield force $F_{p0,1}$: 299021 N;
tensile strength $R_m$ 2033 MPa.

Steel Fiber

Steel fibers adapted to be used in the present invention typically have a middle portion with a diameter D ranging from 0.30 mm to 1.30 mm, e.g. ranging from 0.50 mm to 1.1 mm. The steel fibers have a length l so that the length-to-diameter ratio l/D ranges from 40 to 100.

Preferably, the steel fibers have ends to improve the anchorage in concrete. These ends may be in the form of bent sections, flattenings, undulations or thickened parts. Most preferably, the ends are in the form of three or more bent sections. In one embodiment, steel fibers may be glued.

Figure 4:
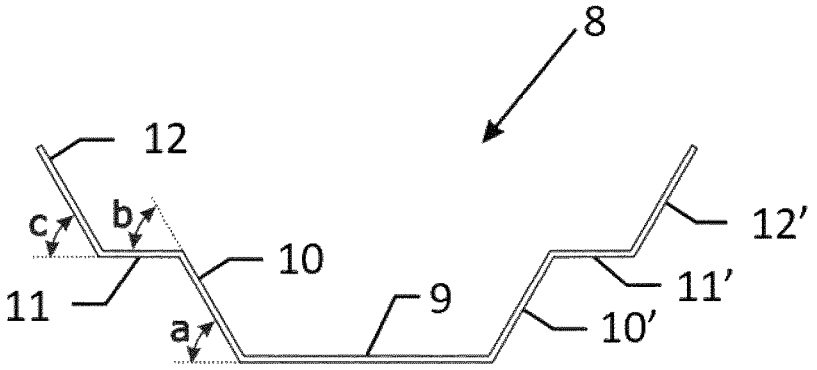
FIG. 4 illustrates a preferable embodiment of a steel fiber.

FIG. 4 illustrates a preferable embodiment of a steel fiber (8). The steel fiber (8) has a straight middle portion (9). At one end of the middle portion (9), there are three bent sections (10), (11) and (12). At the other end of the middle portion (9) there are also three bent sections (10'), (11') and (12'). Bent sections (10), (10') make an angle (a) with respect to a line forming an extension to the middle portion (9). Bent sections (11), (11') make an angle (b) with respect to a line forming an extension to bent sections (10), (10'). Bent sections (12), (12') make an angle (c) with respect to bent sections (11), (11').

The length l of the steel fiber (8) may range between 50 mm and 75 mm and is typically 60 mm.

The diameter of the steel fiber may range between 0.80 mm and 1.20 mm. Typical values are 0.90 mm or 1.05 mm.

The length of the bent sections (10), (10'), (11), (11'), (12) and (12') may range between 2.0 mm and 5.0 mm. Typical values are 3.2 mm, 3.4 mm or 3.7 mm.

The angles (a), (b) and (c) may range between 20° and 50°, e.g. between 24° and 47°.

The steel fibers may or may not be provided with a corrosion resistant coating such as zinc or a zinc aluminium alloy.

In a particular preferable embodiment of the steel fiber, there are four bent sections at each end of the middle portion.

In another particular preferable embodiment of the steel fiber, the middle portion has an elongation at maximum load higher than 4%, e.g. higher than 5%, e.g. higher than 5.5%. Steel fibers with such a high elongation at maximum load may be used in structural applications such as floors on piles, elevated systems and structural wall systems.

Macro-Synthetic Fiber

Examples of macro-synthetic fibers may be selected from carbon fibers, glass fibers, basalt fibers or other non-steel based fibers, such as fibers based upon polyolefins like polypropylene or polyethylene or based upon other thermoplastics.

Arrangements

Figure 5A:
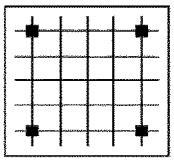
FIG. 5*a* shows a schematic representation of top down view of a concrete slab comprising a two way distributed arrangement of strands.

FIG. 5*a* shows a schematic representation of top down view of a two way distributed, namely for example lengthwise and width wise distributed, arrangement of strands or strand bundles (represented by lines). Supports are schematically represented as squares.

Figure 5B:
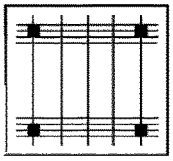
FIG. 5*b* shows a schematic representation of top down view of a concrete slab comprising a one way banded and one way distributed arrangement of strands.

FIG. 5*b* shows a schematic representation of top down view of a one way banded and one way distributed arrangement of strands or strand bundles (represented by lines). Supports are schematically represented as squares.

Figure 5C:
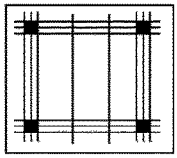
FIG. 5*c* shows a schematic representation of top down view of a concrete slab comprising a one way banded and one way mixed arrangement of strands.

FIG. 5*c* shows a schematic representation of top down view of a one way banded and one way mixed arrangement of strands or strand bundles (represented by lines), whereby a mixed arrangement comprises both strands or bundles both in banded and distributed arrangements. Supports are schematically represented as squares.

Figure 5D:
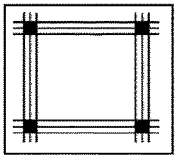
FIG. 5*d* shows a schematic representation of top down view of a concrete slab comprising a two way banded arrangement of strands.

FIG. 5*d* shows a schematic representation of top down view of a two way banded arrangement of strands or strand bundles (represented by lines). Supports are schematically represented as squares.

Figure 5E:
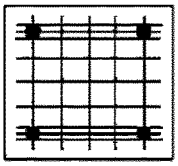
FIG. 5*e* shows a schematic representation of top down view of a concrete slab comprising a one way distributed and one way mixed arrangement of strands.

FIG. 5*e* shows a schematic representation of top down view of a one way distributed and one way mixed arrangement of strands or strand bundles (represented by lines), whereby a mixed arrangement comprises both strands or bundles both in banded and distributed arrangements. Supports are schematically represented as squares.

Figure 5F:
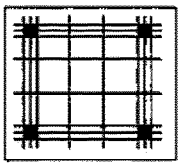
FIG. 5*f* shows a schematic representation of top down view of a concrete slab comprising a two way mixed arrangement of strands.

FIG. 5*f* shows a schematic representation of top down view of a two way mixed arrangement of strands or strand bundles (represented by lines), whereby a mixed arrangement comprises both strands or bundles both in banded and distributed arrangements. Supports are schematically represented as squares.

Example of Replacing Steel Bars

In an embodiment of the invention, a slab according to the invention preferably may not comprise any further reinforcement or reinforcement elements besides the fibers and the post-tension steel strands, especially no steel bars.

For a slab with a thickness of 150 mm and steel bars with a diameter of 6 mm and a spacing 150 mm at the top as well as steel bars with a diameter of 6 mm and a spacing 150 mm at the bottom with a steel cover of 15% this represents 45 kg/m$^3$ steel and a concrete cover of 30 mm (top and bottom) to achieve a resisting bending moment $M_{Rd}$=11.44 (positive and negative moment capacity).

On the other hand, according to the present invention, an equivalent resisting bending moment $M_{Rd}$=11.54 can be achieved with only 24 kg/m$^3$ of steel fibre: DRAMIX® 4D 65/60/BG, i.e. a steel fibre with three bent sections according to FIG. 4 for the same slab with the same concrete. This means that according to the invention the amount or level of steel can be significantly reduced by using steel fibers compared to the amount of steel required and recommended using steel bars. Furthermore, the amount or level of steel fibers according to the invention may preferably be for example below or equal to 1.2 times, preferably 1 time, the amount or level recommended and determined as rebar replacement, especially for example at equivalent performance, preferably in terms of resisting bending moment (positive and negative moment capacity). Accordingly, the amount of steel fibers used according to the present invention may be for example preferably below or equal to 1.2 times, preferably 1.0 time, further preferred between >0 and 1.1 times, the amount or level of steel recommended and used for the steel bars or rebars to be replaced and/or the amount or level of steel fibers may be below or equal 1.2 times, preferably 1 time, further preferred between >0 and 1.1 times, the amount or level recommend as rebar replacement.

Comparison of a Combination of Post-Tensioning with Conventional Reinforcement with Rebars vs. a Combination of Post-Tensioning with Fiber Reinforcement In a comparison of a combination of post-tensioning with conventional reinforcement with rebars vs. a combination of post-tensioning with fiber reinforcement at equivalent flexural capacity it can be seen in the further examples A and B below that the amount of steel used may be significantly reduced by the present invention.

Example A: Slab with Post-Tensioning and Traditional Rebar Reinforcement

Slab thickness: h=200 mm
Slab width: b=1000 mm
Post-Tensioning: 25 Kg/m3
Rebar: 75 Kg/m3

Example B: Slab with Same Post-Tensioning but with Fiber Reinforcement

Slab thickness: h=200 mm
Slab width: b=1000 mm
Post-Tensioning: 25 Kg/m3
Steel fiber dosage: 30 Kg/m3

The slabs of examples A and B above thereby have the same flexural capacity.

Examples of a Slab on Supports

First Example thickness of concrete slab: 0.2 m
applied load:5 kN/m$^2$
distance between neighbouring supports: 7 m×8.5 m
type of support: columns
distance between post-tension steel strands within the straight zones: 0.15 m
not necessary that there are post-tension steel strands outside the straight zones, but in case there are post-tension steel strands, the distance between post-tension steel strands outside the straight zones is greater than 2.5 m, preferably greater than 1.5 m Second Example thickness of concrete slab: 0.15 m
applied load: 2 kN/m$^2$
distance between neighbouring supports: 5 m×5 m
type of support: piles
distance between post-tension steel strands within the straight zones: 0.15 m
not necessary that there are post-tension steel strands outside the straight zones, but in case there are post-tension steel strands, the distance between post-tension steel strands outside the straight zones is greater than 2.0 m, preferably greater than 1.5 m.

The invention claimed is:

1. A concrete slab resting on at least two supports, the concrete slab comprising conventional concrete and a combined reinforcement of draped post-tension steel strands and fibers, wherein the draped post-tension steel strands are positioned: in an upper half of the concrete slab above the at least two supports; and in a lower half of the concrete slab in between the at least two supports, each of said post-tension steel strands having a diameter ranging from 5 mm to 20 mm, and having a tensile strength higher than 1700 MPa, and said fibers being either steel fibers and being present in a dosage ranging from 10 kg/m$^3$ to 75 kg/m$^3$ or being macro-synthetic fibers and being present in a dosage ranging from 1.5 kg/m$^3$ to 9.0 kg/m$^3$, wherein the concrete slab and the at least two supports are fully connected, partially connected or fully disconnected, and wherein an amount of steel fibers used is below 1 time an amount of steel recommended as rebar replacement.

2. The concrete slab according to claim 1, wherein said conventional concrete has a characteristic compressive cube strength of 25 N/mm$^2$ or higher and/or wherein the concrete slab does not contain any further reinforcement elements and/or wherein the concrete slab is cast in one or multiple steps.

3. The concrete slab according to claim 1, wherein said fibers are steel fibers and/or wherein the fibers are glued and/or wherein the macro-synthetic fibers are selected from carbon fibers, glass fibers, basalt fibers or other non-steel based fibers.

4. The concrete slab according to claim 1, wherein said fibers are steel fibers comprising a straight middle portion that have a tensile strength above 1400 MPa.

5. The concrete slab according to claim 1, wherein said fibers are steel fibers having two ends and comprising anchorage ends at both of the two ends, said anchorage ends each comprise three or four bent sections and/or wherein said steel fibers have an elongation capacity of between 2.5 and 12% and/or wherein the concrete slab is strain hardening in bending.

6. The concrete slab according to claim 1, wherein the steel fibers have a length of 10 mm to 100 mm.

7. The concrete slab according to claim 1, wherein said at least two supports are concrete supports, masonry supports, steel supports or supports combining concrete, masonry and/or steel and/or wherein the supports are part of a foundation and/or wherein said concrete slab has a uniform average density and/or wherein said concrete slab is cast in one day and/or wherein said concrete slab contains only the fibers and the post-tension steel strands as reinforcement elements and/or wherein conventional concrete has normal shrinkage and/or does not encompass low shrinkage concrete and/or wherein said concrete slab is free of a vapor barrier and/or wherein the concrete slab has a thickness between 4 cm and 75 cm and/or has a width higher than the thickness and/or has a width higher than the thickness and a length higher than the thickness.

8. The concrete slab according to claim 1, wherein the at least two supports comprise columns, walls, piles or beams or any combination thereof or any other elements acting as vertical supports, and/or wherein tension is applied to the post-tension steel strands only after the concrete has been cast and the post-tension steel strands remain in place also once the concrete is completely cured/hardened and/or wherein the post-tension steel strands have a tensile strength higher 1800 MPa and/or wherein the post-tension steel strands have a maximum breaking load of higher than 190 KN and/or wherein the post-tension steel strands comprise anchor systems and/or ducts or sheathing.

9. The concrete slab according to claim 1, wherein the concrete slab further comprises plastic slip-sheets between said concrete slab and the at least two supports.

10. The concrete slab according to claim 1, wherein the post-tension steel strands are in a banded-banded steel strands configuration or in a banded-distributed steel strands configuration and/or wherein the post-tension steel strands are used for bonded or unbonded post-tensioning and/or wherein the anchors for the post-tension steel strands are designed so as to reduce bursting behind the post-tensioning anchors during or after post-tensioning and/or wherein the fibers are substantially homogenously or homogeneously distributed in the concrete slab.

11. The concrete slab according to claim 1, wherein the concrete slab and the at least two supports are either permanently fully connected, so that the concrete slab is not free to move from the at least two supports, permanently fully disconnected, so that the concrete slab is free to move, partially connected, so that the concrete slab is partially free to move in certain directions or temporarily disconnected, so that the concrete slab is free to move at least temporarily.

12. The concrete slab according to claim 1, said at least two supports being arranged to form a regular rectangular pattern or quadrilateral shape, said concrete slab comprising straight zones connecting the at least two supports via a shortest distance in two directions post-tension steel strand bundles being present only in said straight zones in a closely-spaced arrangement, where a maximum distance between bundles does not exceed 1.5 m and/or said concrete supports being arranged to form a regular rectangular pattern or quadrilateral shape, said concrete slab comprising straight zones connecting the supports via the shortest distance in two directions post-tension steel strand bundles in one direction being present outside said straight zones in a largely-spaced arrangement, where the maximum distance between bundles exceed 1.5 m.

13. The concrete slab according to claim 1, wherein a span of the concrete slab between two of the at least two supports for a thickness is increased by between 5 and 50% over the concrete slab with a same slab thickness but without fibers and post-tension steel strands and/or wherein a thickness of the concrete slab for a span between two of the at least two supports is reduced by between 5 and 50% over a concrete slab with a same span but without fibers and post-tension steel strands.

14. The concrete slab according to claim 1, wherein an amount of concrete is reduced for a slab thickness or a span over a concrete slab but without fibers and post-tension steel strands by between 5 and 50%.

15. The concrete slab according to claim 1, wherein a combination of post-tensioned steel strands and fibers increases a structural capacity for flexure, deflection, shear, punching shear, structural integrity, temperature resistance and/or shrinkage resistance over a concrete slab without steel fibers and/or steel strands.

16. The concrete slab according to claim 1, wherein said conventional concrete has a characteristic compressive cube strength of 28 $N/mm^2$ or higher.

17. The concrete slab according to claim 1, wherein the macro-synthetic fibers are polyolefin fibers, or wherein an amount of steel fibers used is below or equal to 1.0 time an amount of steel recommended and used for the steel bars or rebars to be replaced.

18. The concrete slab according to claim 1, wherein said fibers are steel fibers comprising a straight middle portion that have a tensile strength above 1500 MPa.

19. The concrete slab according to claim 1, wherein said steel fibers have an elongation capacity of between at least 3.5% and 12%.

20. The concrete slab according to claim 1, wherein the steel fibers are present in the concrete slab in a dosage ranging from 20 $kg/m^3$ to 30 $kg/m^3$, and/or wherein the fibers have a length of between >10 mm and 70 mm.

21. The concrete slab according to claim 1, wherein the supports are not part of a foundation, and/or wherein the concrete slab has a thickness between 5 cm and 65 cm.

22. The concrete slab according to claim 1, wherein the at least two supports are point supports, linear supports or area supports, and/or wherein the post-tension steel strands have a tensile strength higher 1900 MPa, and/or wherein the post-tension steel strands have a maximum breaking load of higher than 195 kN.

23. The concrete slab according to claim 1, wherein the concrete slab further comprises plastic slip-sheets between said concrete slab and the at least two supports at points of contact between the slab and the supports, or wherein the plastic slip-sheets are not present between the slab and the supports.

24. The concrete slab according to claim 1, wherein the post tension steel strands are arranged in a configuration without maximum and/or minimum spacing requirements.

25. The concrete slab according to claim 1, wherein a span of the concrete slab between two of the at least two supports for a thickness is increased by between 10 and 40% over the concrete slab with a same slab thickness but without fibers and post-tension steel strands, and/or wherein a thickness of the concrete slab for a span between two of the at least two supports is reduced by between 10 and 40% over a concrete slab with a same span but without fibers and post-tension steel strands.

26. The concrete slab according to claim 1, wherein an amount of concrete is reduced for a slab thickness or a span over a concrete slab but without fibers and post-tension steel strands by between 10 and 40%.

27. The concrete slab according to claim 1, wherein the concrete slab does not contain rebars or steel nets or steel mesh.

28. The concrete slab according to claim 1, wherein the concrete slab is fully casted.

29. A concrete slab resting on at least two supports, the concrete slab comprising conventional concrete and a combined reinforcement of draped post-tension steel strands and fibers, wherein the draped post-tension steel strands are positioned: in an upper half of the concrete slab above the at least two supports; and in a lower half of the concrete slab in between the at least two supports, each of said post-tension steel strands having a diameter ranging from 5 mm to 20 mm, and having a tensile strength higher than 1700 MPa, and said fibers being either steel fibers and being present in a dosage ranging from 10 $kg/m^3$ to 75 $kg/m^3$ or being macro-synthetic fibers and being present in a dosage ranging from 1.5 $kg/m^3$ to 9.0 $kg/m^3$, wherein the concrete slab and the at least two supports are fully connected, partially connected or fully disconnected, and wherein the concrete slab is free of a vapor barrier.

* * * * *